US005653418A

United States Patent [19]

Olson

[11] Patent Number: 5,653,418

[45] Date of Patent: Aug. 5, 1997

[54] RAM-TYPE BLOWOUT PREVENTER

[75] Inventor: Richard A. Olson, Houston, Tex.

[73] Assignee: Cooper Cameron Corporation, Houston, Tex.

[21] Appl. No.: 583,561

[22] Filed: Jan. 5, 1996

Related U.S. Application Data

[62] Division of Ser. No. 229,700, Apr. 19, 1994, abandoned .

[51] Int. Cl.[6] ..... E21B 33/06

[52] U.S. Cl. ..... 251/1.3; 92/13.6

[58] Field of Search ..... 251/1.1, 1.3; 92/13.3, 92/13.6, DIG. 4

[56] References Cited

U.S. PATENT DOCUMENTS

| | | | |
|---|---|---|---|
| 2,649,842 | 8/1953 | Caldwell et al. | 92/DIG. 4 |
| 3,946,806 | 3/1976 | Meynier, III | 166/55 |
| 4,043,389 | 8/1977 | Cobb | 166/55 |
| 4,132,267 | 1/1979 | Jones | 166/55 |
| 4,249,458 | 2/1981 | Massing | 92/13.6 X |
| 4,313,496 | 2/1982 | Childs et al. | 166/55 |
| 4,492,359 | 1/1985 | Baugh | 251/1 A |
| 4,504,037 | 3/1985 | Beam et al. | 251/1 A |
| 4,538,506 | 9/1985 | Mattsson | 92/13.3 |
| 5,067,323 | 11/1991 | Bennett et al. | 92/13.6 X |
| 5,294,088 | 3/1994 | McWhorter et al. | 251/1.3 |

*Primary Examiner*—John C. Fox
*Attorney, Agent, or Firm*—Conley, Rose & Tayon, P.C.

[57] ABSTRACT

An actuator for a ram-type blowout preventer used either with a shear ram blowout preventer or a pipe ram blowout preventer. The actuator includes a pressure-responsive cylinder having an operating piston disposed therewithin. The piston includes a shaft for transmitting relative motion to the ram in the blowout preventer. A reversible annular member is disposed around the periphery of the piston to provide a variable pressure force in a shear ram blowout preventer and to limit the stroke of the piston in a pipe ram blowout preventer. The annular member includes a pair of annular flanges extending radially inward to form a channel therebetween. The channel receives the periphery of the piston which is moveable within the channel between the flanges. In a shear ram blowout preventer, the annular member increases the annular pressure area of the piston during the shearing stroke to increase the pressure force on the rams and their seals during the shearing of the pipe. After the pipe has been sheared, the annular member bottoms on the end of the cylinder allowing the piston to continue to travel in the channel such that the reduced annular pressure area of the piston reduces the pressure force on the rams and their seals during the sealing stroke to seal the bore after the pipe has been sheared. The reversible annular member is reversed on the piston in a pipe ram blowout preventer. In the reverse position, the annular member increases the annular pressure area during the sealing stroke until the annular member bottoms on the end of the cylinder. The piston is then allowed to continue to travel a short distance within the channel until the piston engages the other annular flange of the annular member thereby reducing the stroke of the piston. In the shear ram blowout preventer, the piston is allowed to engage the bottom of the cylinder for a full stroke equal to the axial length of the cylinder while the piston bottoms out on the annular flange of the annular member in a pipe ram blowout preventer to reduce the stroke of the operating piston within the cylinder.

14 Claims, 6 Drawing Sheets

RAM-TYPE BLOWOUT PREVENTER

RELATED APPLICATION

This application is a divisional of U.S. application Ser. No. 08/229,700 filed Apr. 19, 1994 now abandoned.

BACKGROUND OF THE INVENTION

This invention relates generally to ram-type blowout preventers, and, more particularly, to actuators for the rams of a blowout preventer either for shearing a pipe extending through the bore of the blowout preventer and then sealing across the bore or for sealing around a pipe extending through the bore. Still more particularly, the invention relates to an apparatus for enhancing the pressure area and limiting the stroke of the operating piston of the actuator.

As is well known in the art, a ram-type blowout preventer composes a housing connected to a wellhead with the housing having a bore which is in alignment with the wellbore. Rams are movable within guideways extending transversely from the bore between an outer position removed from the bore and inner position across the bore and engaging with one another to seal off the bore. In a pipe ram blowout preventer, the inner ends of the rams have recesses for sealing around the pipe suspended within the bore. In a shear ram blow-out preventer, the inner ends of the rams include blades to shear pipe and also seal which may be flat or otherwise complimentary for sealing across the open bore after the pipe is sheared. Upon inward movement of the rams into the bore, the sealing engagement between the seals carried on the rams effectively terminates any fluid flow through bore.

A hydraulically actuated cylinder having a piston interconnected to the respective ram by means of a shaft or a "stem" effects the movement of the rams into sealing engagement. The stem is provide with stem packings or seals disposed about the stem to prevent pressure and fluid in the bore from being communicated along the stem into the hydraulic circuit of cylinder.

The actuator is rigidly affixed to one end of the housing and extends outwardly in the same direction on either side of a respective ram stem. The actuator includes a bonnet in which is disposed a piston and cylinder with the bonnet being affixed to the housing by means of bonnet bolts. The cylinder is connected to a hydraulic circuit for providing fluid under pressure to move the piston within the cylinder. The piston is disposed on the stem to reciprocate the ram.

Typical shear ram blowout preventers are shown in U.S. Pat. Nos. 3,946,806; 4,043,389; 4,313,496; and 4,132,267. Typical pipe ram blowout preventers are shown in U.S. Pat. Nos. 4,492,359 and 4,504,037. A preferred ram-type blowout preventer is shown on pages 637–645 of the *Composite Catalog of Oilfield Equipment and Services*, 1992–93, published by World Oil.

As can be appreciated, a substantial pressure force must be applied to the shear rams of a shear ram blowout preventer to shear the pipe extending through the bore of the preventer. Various means have been employed in the prior art actuator to ensure that the actuator provided adequate shear force. For example, a booster piston and cylinder may be piggy backed onto the primary operating piston and cylinder to ensure sufficient force to both shear the pipe and seal the bore.

The actuators for the rams are designed for removal of the rams in the field to change the pipe rams or shear rams of the blowout preventer. One method is the use of ram change pistons and cylinders whereupon removal of the bonnet bolts, the ram change pistons and cylinders are hydraulically actuated causing the bonnet to travel radially inward and outward with respect to the blowout preventer housing in a manner like that of the ram operating piston. Upon moving the bonnet into the outward position because it is no longer restrained by the bonnet bolts, the pipe ram or shear ram, as the case may be, is also pulled along the ram guideway outwards of the blowout preventer bore so as to be removed from the housing and thus exposed and rendered accessible for servicing or replacement.

It is often desirable to either replace a pipe ram with a shear ram or vice versa. Since the stroke of a shear ram is longer than the stroke of a pipe ram, it is necessary that a plurality of parts be replaced to modify the actuator to accommodate another type of ram. For example, a much greater force is required on a shear ram than on a pipe ram since the shear ram must not only shear the pipe extending through the blowout preventer housing bore but also must then seal the resulting open bore. Thus, in adapting an actuator previously used for a pipe ram, the standard bonnet must be replaced with a large bore shear bonnet to provide a larger capacity operating piston to increase force on the shear ram to shear the pipe. The adaptation of the actuator for a shear ram, particularly when done in the field, is complicated and time consuming.

Further, the substantial operating piston force required to shear the pipe in a shear ramtype blowout preventer is much greater than the amount of force required to seal the open bore after the pipe has been sheared. This over capacity force on the elastomeric seals of the shear ram reduces the life of the seals. It is preferred that the operating piston force on the seals be reduced after the shear rams have sheared the pipe. However, the hydraulic pressure on the operating piston frequently remains at the same high level during both the shearing and sealing operations.

The present invention overcomes the deficiencies of the prior art.

SUMMARY OF THE INVENTION

The actuator of the present invention includes an operating cylinder disposed between a bonnet and a cylinder head for receiving an operating piston having a stem for transmitting relative motion to the ram of a ram-type blowout preventer. The actuator further includes a booster and stroke limiting apparatus disposed around the circumference of the operating piston. The booster and stroke limiting apparatus is in the form of an annular member having first and second annular flanges extending radially inward to form a channel therebetween. The channel slidingly receives the circumference of the piston and allows the piston to move between the first and second annular flanges.

The booster and stroke limiting apparatus allows the actuator to be used either with a shear ram blowout preventer or a pipe ram blowout preventer. In a shear ram blowout preventer, the annular ring is positioned around the operating piston such that the first annular flange is most remote from the ram and the second annular flange is radially inward of the first annular flange. Upon the application of hydraulic pressure to close the ram, the first annular flange of the annular member engages the piston to increase the annular pressure area of the piston within the operating cylinder. During the shearing stroke, the pipe within the shear ram blowout preventer is sheared. The shearing stroke ends upon the annular member engaging the bottom of the operating cylinder thus allowing the hydraulic pressure only to be applied to the smaller pressure area of the piston. The piston continues to travel within the channel of the annular member until the piston also engages the bottom of the cylinder. During this sealing stroke of the piston, the seals of the shear rams sealingly engage.

In a pipe ram blowout preventer, the annular member is reversed or turned over such that the second annular flange is most remote from the pipe ram with the first annular flange being radially inward of the second annular flange. Upon the application of hydraulic pressure to the actuator, the second annular flange engages the piston to increase the annular pressure area. The initial sealing stroke ends upon the annular member engaging the bottom of the cylinder. The piston continues to travel within the channel until the piston engages the first annular flange. Such engagement of the piston on the first annular flange prevents the piston from engaging the bottom of the cylinder thereby shortening the stroke of the piston when compared to its stroke in a shear ram blowout preventer.

The actuator of the present invention has many advantages over the prior art. The actuator may be used either with a shear ram blowout preventer or a pipe ram blowout preventer merely upon the appropriate positioning of the booster and stroke limiting apparatus around the operating piston. In the shear ram blowout preventer, the booster and stoke limiting apparatus allows a large pressure force to be applied to the shear rams during the shearing stroke and a reduced pressure force to be applied to the seals of the shear rams during the sealing stroke. In a pipe ram blowout preventer, the booster and stroke limiting apparatus shortens the stroke of the operating piston. Further, the actuator of the present invention is lighter in weight and allows an operating cylinder with a larger diameter than that of the prior art so as to increase the annular pressure area for the application of a greater pressure force on the rams of a shear ram blowout preventer.

Other objects and advantages of the invention will appear from the following description.

BRIEF DESCRIPTION OF THE DRAWINGS

For a detailed description of a preferred embodiment of the invention, reference will now be made to the accompanying drawings wherein.

DESCRIPTION OF THE PREFERRED EMBODIMENTS

Figure 1:
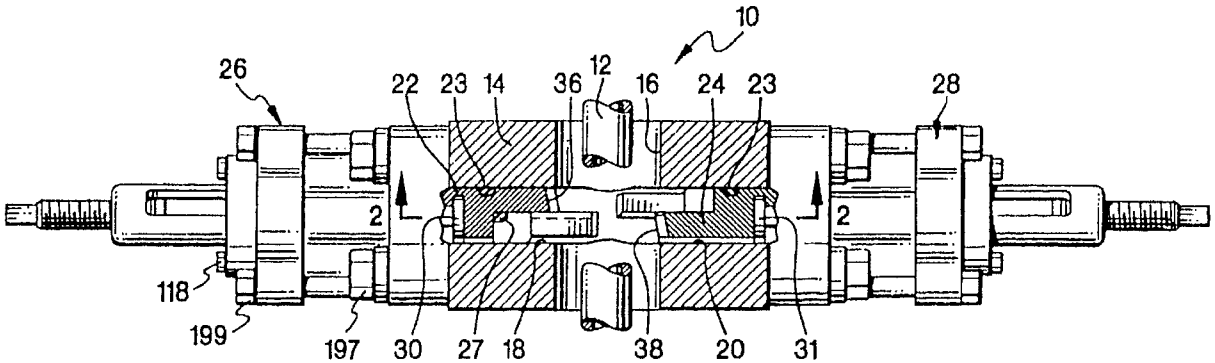
FIG. 1 is a side elevation view, partly in cross-section, of a shear ram-type blowout preventer utilizing the present invention.
Figure 2:
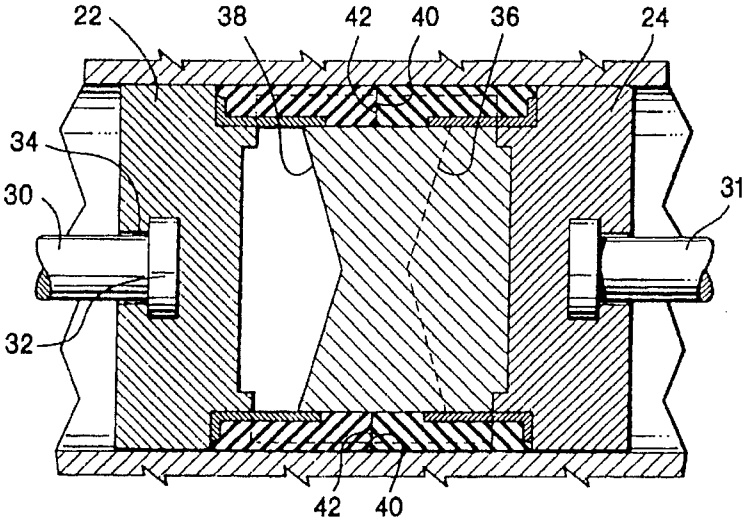
FIG. 2 is an enlarged cross-section view through plane 2—2 of FIG. 1.

Referring initially to FIGS. 1 and 2, there is shown a ram-type blowout preventer 10 of the shearing type in that it is able to shear that portion of the pipe string 12 positioned within the blowout preventer 10 when an emergency condition arises requiring the shearing of the pipe string and the sealing of the well. Blowout preventer 10 includes a body or housing 14 with a vertical bore 16 extending therethrough. Pipe string 12 passes through bore 16 and extends downwardly into the wellbore. Housing 14 may include flanges (not shown) so that blowout preventer 10 may be connected in a wellhead stack. Ram guideways 18, 20 extend transversely outward from opposite sides of bore 16. First and second shearing rams 22 and 24 are positioned for reciprocation within guideways 18 and 20, respectively.

Hydraulic actuation means, such as actuators 26, 28, are provided to move or extend rams 22, 24, respectively, in response to fluid pressure into bore 16 for shearing that portion of the pipe string 12 which extends through bore 16 and for retracting rams 22, 24 from the bore 16. Actuators 26, 28 each include piston and cylinder means, hereinafter described in further detail, and a stem or shaft 30, 31 connecting the pistons to the rams 22, 24, respectively. Suitable hydraulic means are provided to deliver fluid under pressure to the piston and cylinder means. In one method of affixing rams 22, 24 to shafts 30, 31, each shaft 30, 31 includes a head 32 which is received in a slot 34 in the radial outer end of ram 22. Thus, ram 22 may be easily disconnected from shaft 30 by removing ram 22 from guideway 18 and lifting ram 22 off of the head 32 of shaft 30.

Each of shear rams 22, 24 includes cutting blades 36, 38. Upper cutting blade 36 is disposed on ram 22 and lower cutting blade 38 is disposed on ram 24. As shown in FIG. 2, the cutting blades are integral with the rams. As is seen in FIG. 1, cutting blades 36, 38 are positioned so that the cutting edge of lower blade 38 passes just below the cutting edge of upper blade 36 in shearing relation to a section of the pipe string 12.

Seal means are also mounted on rams 22, 24 adjacent the sides of blades 36, 38. Each seal means includes side seals 40 on each side of upper blade 36 and side seals 42 on each side of lower blade 38. Side seals 40 are adapted to sealingly engage side seals 42. Rams 22, 24 also have top seals 23 which extend from side seals 40, 42 across the upper periphery of the rams to sealingly engage the side seals. Blade seal 27 rests below upper blade 36 and sealingly engages side seals 40, 42 and lower blade 38 when rams 22 and 24 are in the closed position of FIG. 2.

Figure 3:
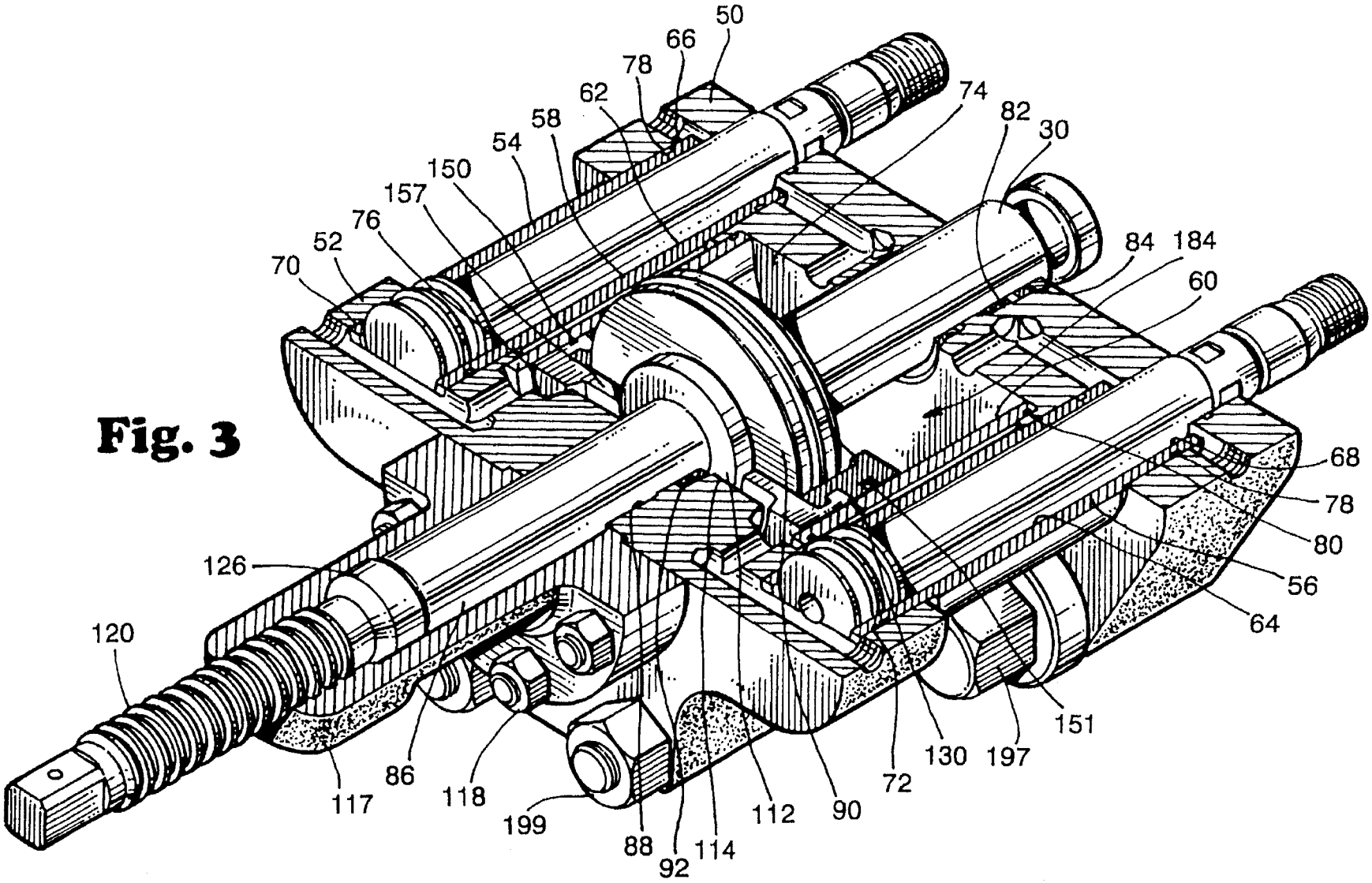
FIG. 3 is a perspective view of an actuator for a shear ram-type blowout preventer in the open position utilizing the booster and stroke limiting apparatus of the present invention.

Referring now to FIG. 3, there is shown the configuration of the actuator of the present invention for the shear ram blowout preventer 10. Actuator 26, shown in FIG. 1, will be described in detail, it being appreciated that the description of actuator 26 is identical to the description of opposed actuator 28. Actuator 26 includes a bonnet 50, a cylinder head 52 with a pair of ram change cylinders 54, 56 and an operating cylinder 58 disposed therebetween. Ram change cylinders 54, 56 and operating cylinder 58 include cylindrical piston bores 62, 64 and 60, respectively.

Bonnet 50 and cylinder head 52 each include aligned and opposed counterbores 66, 68 and 70, 72, respectively, for receiving the terminal ends of ram change cylinders 54, 56. Further, bonnet 50 includes a central counterbore 74 and cylinder head 52 includes an annular groove or recess 76 which is aligned and opposed to counterbore 74 so as to receive the respective terminal ends of operating cylinder 58. Ram change cylinders 54, 56 each include an exterior annular groove on each of their terminal ends for receiving a seal member 78 for sealingly engaging the cylindrical walls formed by counterbores 66, 68 and 70, 72. Likewise, external annular grooves are disposed on each terminal end of operating cylinder 58 for housing seal members 80, such as o-rings, for sealingly engaging the cylindrical outer walls formed by central counterbore 74 and annular recess 76.

Bonnet 50 further includes a central bore 82 for slidingly receiving the leading end of shaft 30. Packing means 84 is disposed in central bore 82 to sealingly engage the external cylindrical surface of shaft 30. An operating piston 90 is disposed on the outer radial end of shaft 30 such that operating piston 90 is disposed within operating cylinder 58. A trailing rod 86 is disposed on and extends from the other side of operating piston 90 opposite to shaft 30. Trailing rod 86 is slidingly received within a main bore 88 in cylinder head 52. Packing seals 92 are provided in an annular recess in main bore 88 for sealingly engaging the outer cylindrical surface of trailing rod 86.

Figure 4:
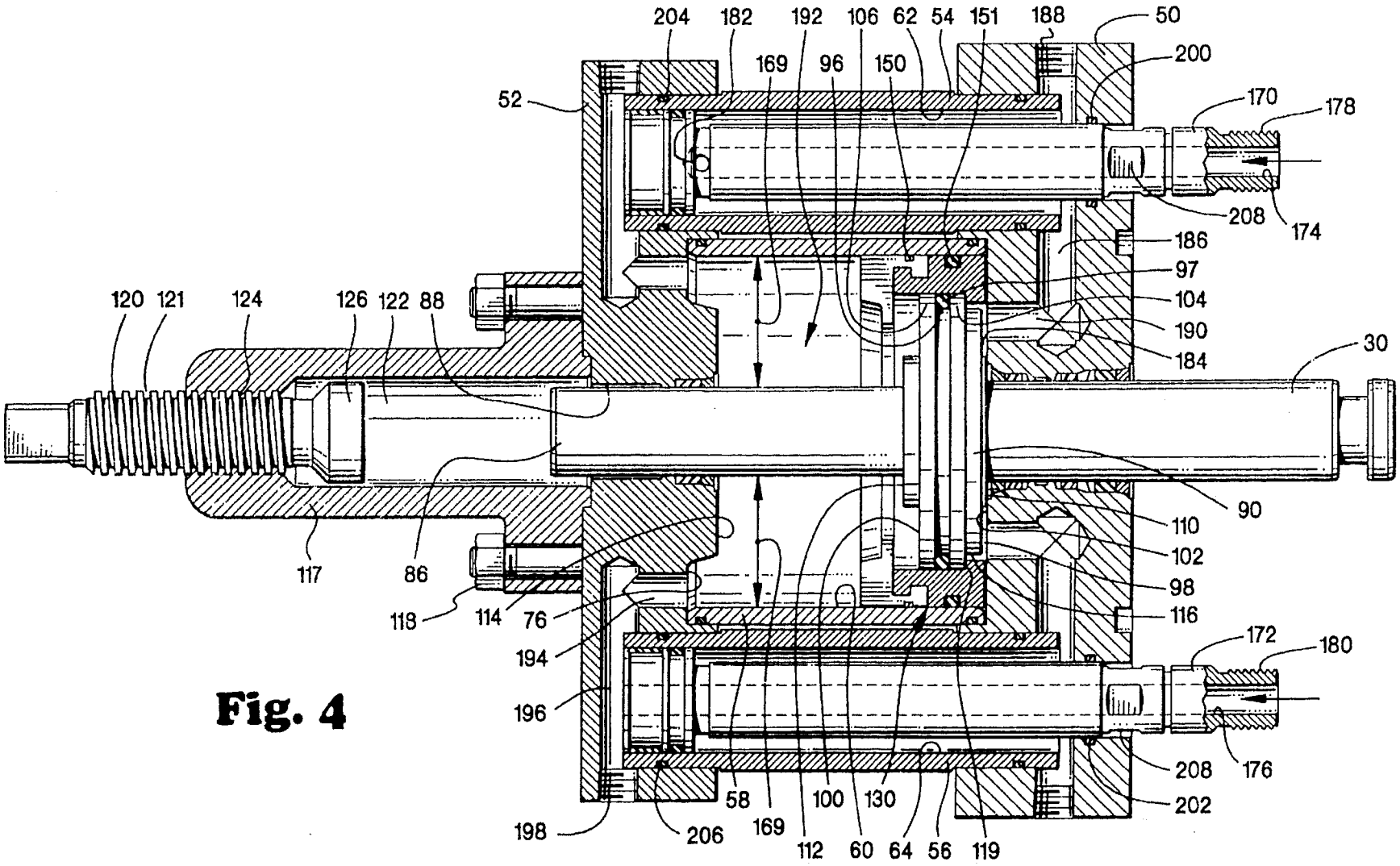
FIG. 4 is a cross-sectional side elevation view of the actuator for the shear ram-type blowout preventer shown in FIG. 3 in the closed position.

Referring now to FIG. 4, operating piston 90 is generally circular in cross section and includes a inwardly radial facing annular bearing surface 98 and an outward radial facing annular bearing surface 100. Operating piston 90 also includes an inwardly radial facing annular stop shoulder 110 adjacent shaft 30 and an outwardly radial facing annular stop shoulder 112 adjacent trailing rod 86. Inwardly facing stop shoulder 110 is adapted to engage the bottom surface 102 of central counterbore 74 in the closed position as shown in FIG. 4. Outwardly facing annular stop shoulder 112 is adapted to engage the annular boss 114 formed by annular recess 76 in the open position shown in FIG. 3. A pair of annular flanges 104, 106 form an annular sealing groove 96 around the outer circumference of operating piston 90. A seal member 97, such as an o-ring, is disposed in groove 96. Annular flange 104 has a larger diameter than annular bearing surface 98 thus forming an annular recess 116 and a radially inwardly facing annular stop surface 119.

The trailing rod 86 extends radially outward of cylinder head 52 through bore 88 and is received within a lock screw housing 117 which is fastened to cylinder head 52 by fastener means such as bolts and nuts 118. Lock screw housing 117 includes a central aperture 122 for receiving the terminal end of trailing rod 86. Central aperture 122 includes a threaded reduced diameter portion 124 for threadingly receiving a lock screw 120 having external threads 121. Manual lock screw 120 includes an enlarged diameter head 126 which is disposed within central aperture 122. The terminal end of head 126 is adapted to abut the terminal end of trailing rod 86.

Figure 5A:
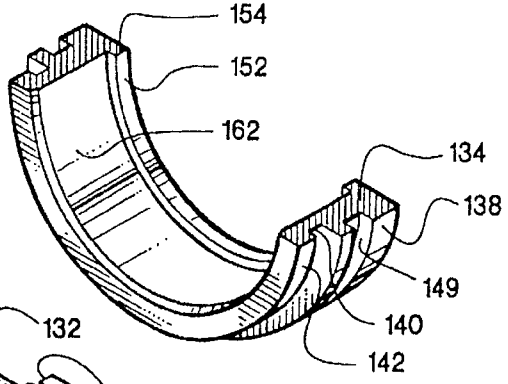
FIGS. 5A and 5B are perspective views of the booster piston cross section and stroke limiting spacer, respectively, of the booster and stroke limiting apparatus of the present invention shown in FIGS. 3 and 4.
Figure 5B:
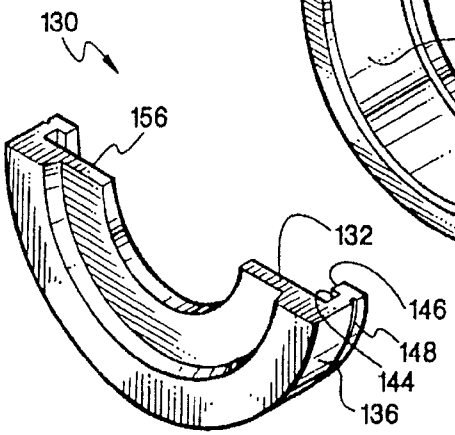
Figure 6:
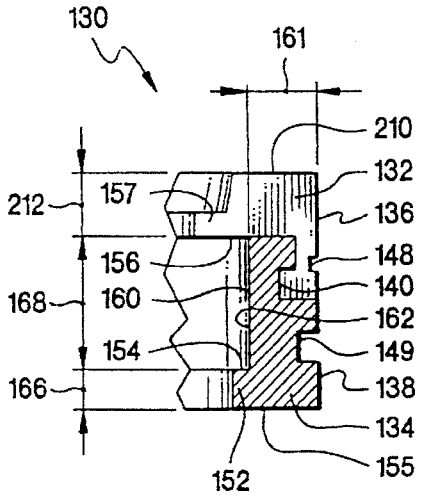
FIG. 6 is a cross-sectional view of the booster piston and stroke limiting spacer assembled into the booster and stroke limiting apparatus of the present invention shown in FIGS. 5A and 5B.

Referring now to FIGS. 3–6 and particularly to FIGS. 5A, 5B and 6, there is shown the booster and stroke limiting apparatus 130 of the present invention which forms an adapter mounted around the circumference of operating piston 90. The booster and stroke limiting apparatus 130 includes a stroke limiting spacer 132 and a booster piston 134. Spacer 132 and booster piston 134 are circular in cross-section and form cylindrical surfaces 136, 138, respectively, at their circumference which are dimensioned to be slidingly received within the cylindrical piston bore 60 of operating cylinder 58.

Stroke limiting spacer 132 is connected to booster piston 134 by one of several methods. The preferred method is shown in FIGS. 5A, 5B and 6 where booster piston 138 is an annular ring like member having an annular J-slot groove 140 forming a radially extending annular flange 142. Stroke limiting spacer 132 may comprise a pair of C-shaped members including a radially inwardly facing J-shaped groove 144 forming an inwardly directed annular flange 146. Upon connection of booster piston 138 with stroke limiting spacer 132, inwardly directed annular flange 146 of each C-shaped half of stroke limiting spacer 132 is received within J-slot groove 140 of booster piston 138. Likewise, outwardly directed annular flange 142 of booster piston 138 is received in J-slot groove 144 of each of the C-shaped halves of stroke limiting spacer 132. Such interlocking engagement connects piston 134 to spacer 132. Stroke limiting spacer 132 includes an external annular groove 148 for receiving an annular seal member 150, such as an o-ring, which when disposed within groove 148 holds the two C-shaped halves of spacer 132 in place around annular booster piston 134. Once the booster and stroke limiting apparatus 130 is disposed within the piston bore 60 of operating cylinder 58, the cylindrical walls of bore 60 of operating cylinder 58 maintain the interlocking connection between spacer 132 and booster piston 134. Booster piston 134 includes an annular external groove 149 for receiving an annular seal member 151, such as an o-ring. An alternative method of connecting spacer 132 and booster piston 134 is to provide cap screws which extend through spacer 132 for threaded engagement in tapped bores in booster piston 134.

Booster and stroke limiting apparatus 130 is mounted around the outer circumference of operating piston 90. Booster piston 134 includes an inwardly radially directed flange 152 forming a radial annular bearing shoulder 154. Further, stroke limiting spacer 132 includes an annular flange 157 having an inwardly radially facing annular bearing surface 156. As best shown in FIG. 3, upon the assembly of stroke limiting spacer 132 and booster piston 134 to form booster and stroke limiting apparatus 130, annular bearing shoulder 154 and inwardly facing annular beating surface 156 form an annular channel 160 in which is disposed annular flanges 104, 106 of operating piston 90. The seal member 97 disposed in annular groove 96 sealingly engages the inner cylindrical wall 162 of channel 160. Likewise, the sealing member 151 in annular groove 149 sealingly engages the cylindrical bore 60 of operating cylinder 58.

Figure 7A:
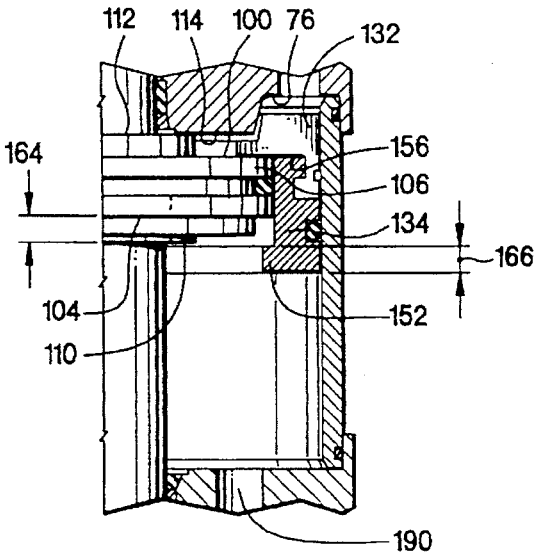
FIGS. 7A, B, and C illustrate the operating piston and the booster and stroke limiting apparatus prior to the shearing and sealing strokes, after the shearing stroke, and then after the sealing stroke, respectively.
Figure 7B:
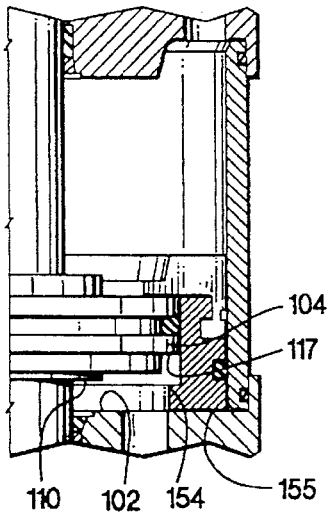
Figure 7C:
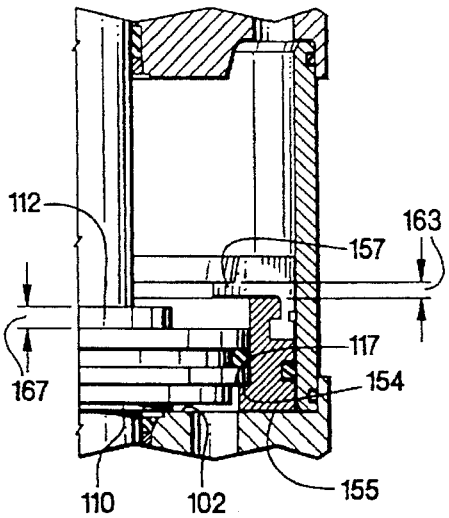

Referring now to FIGS. 6, 7A, 7B and 7C, the height 164 between annular stop shoulder 110 and the face of annular flange 104 is greater than the thickness 166 of annular flange 152 of booster piston 138. Further, the thickness 165 of annular flange 159 is less than the height 167 of shoulder 112 such that shoulder 112 is allowed to engage boss 114 before flange 106 can engage surface 156 of annular flange 157 in the open position shown in FIG. 7A. Upon the assembly of booster and stroke limiting apparatus 130 as shown in FIG. 6, the radial height 168 between shoulder 154 and surface 156 is the maximum distance of travel of operating piston 90 within the annular channel 160. In the closed position as shown in FIG. 7C, the operating piston 90 together with the booster and stroke limiting apparatus 130 moves radially inward within cylinder 58 until the bottom or inwardly facing radial stop surface 155 of apparatus 130 engages and bottoms out on the bottom surface 102 of counterbore 74 as shown in FIG. 7B. Upon surface 155 engaging surface 102, the shearing stroke of booster and stroke limiting apparatus 130 is terminated. However, operating piston 90 continues its travel and sealing stroke within annular channel 160 until annular stop shoulder 110 of operating piston 90 engages bottom surface 102 of counterbore 74 as shown in FIG. 7C. Operating piston 90 thus has a longer stroke than that of booster and stroke limiting apparatus 130 since operating piston 90 may continue to travel within operating cylinder 58 by continued movement within annular channel 160 even though the booster and stroke limiting apparatus 130 has terminated its shearing stroke by the engagement of surfaces 102 and 155.

Referring now to FIGS. 4 and 7, as can be appreciated, upon the hydraulic actuation of operating piston 90 and booster and stroke limiting apparatus 130, hydraulic pressure is applied across the annular area 169 formed by operating piston 90 and booster and stroke limiting apparatus 130. Referring particularly to FIG. 6, the annular flange 157 of stroke limiting spacer 132 has a reduced diameter to allow spacer 132 to have a portion thereof be received within annular recess 76 thus allowing surface 112 of operating piston 90 to bottom on boss 114. Upon the application of hydraulic pressure to close the shear rams 22, 24, the inwardly facing surface 156 of stroke limiting spacer 132 engages the annular bearing surface 100 of operating piston 90 such that booster and stroke limiting apparatus 130 and operating piston 90 move in tandem through the piston bore 60 of operating cylinder 58 until stop surface 155 of booster piston 134 engages surface 102 of counterbore 74 as shown in FIG. 7B. This movement of operating piston 90 and booster and stroke limiting apparatus 130 may be called the shearing stroke since the pipe 12 is fully severed by this stroke of actuator 26 and opposed actuator 28. However, the seals of shear rams 22, 24 have not yet engaged. The further stroke of operating piston 90 within annular channel 160 after the termination of the travel of the booster and stroke limiting apparatus 130 causes shear rams and ram seals to travel within further bore 16 and to sealingly engage and is called the sealing stroke of actuators 26 and 28. Since the effective pressure area of operating piston 90 is less than that of the combined areas of operating piston 90 and booster and stroke limiting apparatus 130, the pressure force during the sealing stroke is less than the pressure force during the shearing stroke. The pressure area is reduced by the annular area 161 shown in FIG. 6 which is the thickness of the cylinder wall 162 of apparatus 130.

Referring now to FIG. 4, to effect the shearing and sealing strokes of actuators 26 and 28, hydraulic fluid under pressure is provided to housing 14 of blowout preventer 10. The hydraulic fluid is provided through ports (not shown) within housing 14. A pair of ram change pistons 170, 172 are reciprocably disposed within ram change cylinders 54, 56, respectively. Ram change pistons 170, 172 include seals 200, 202, respectively, for sealingly engaging bonnet 50 and further include seals 204, 206 for sealingly engaging the cylindrical wall 62, 64 of ram change pistons 54, 56, respectively. Ram change pistons each include hydraulic bores 174, 176 which communicate with the hydraulic ports in housing 14 by threadingly engaging the threaded terminal ends 178, 180 of ram change pistons 170, 172, respectively, into threaded bores in the side of housing 14 which are in communication with the hydraulic ports of housing 14 and thus the source of hydraulic pressure.

The source of the hydraulic pressure typically includes a set of accumulators (not shown) which provide fluid under pressure, such as at a pressure of approximately 3,000 psi. The accumulators hydraulically communicate with housing 14 through a regulator (not shown) to regulate the pressure of the fluid being provided to blowout preventer 10. A bypass around the regulator may be provided so as to provide full fluid pressure to blowout preventer 10 if desired.

Ram change piston 170 receives fluid pressure from the ports of housing 14 for the purpose of actuating rams 22, 24 into the open position shown in FIG. 3. The hydraulic fluid passes through hydraulic bore 174 as shown by the arrow in FIG. 4 and passes into ram change cylinder 54 through a transverse cross drill port 182 in ram change piston 170 and into cylinder bore 62. A hydraulic passageway is provided between cylinder bore 62 and the radial inner chamber 184 of operating cylinder 58, best shown in FIG. 3. This passageway is formed by a drilled bore 186 which is plugged at 188 and an intersecting transverse bore 190. A like passageway is provided between inner chamber 184 and ram change cylinder bore 64 to allow the simultaneous passage of hydraulic fluid into ram change cylinder 56. As operating piston 90 and booster and stroke limiting apparatus 130 travel radially outward, the radially outer chamber 192 of cylinder 62, best shown in FIG. 4, contracts forcing the hydraulic fluid in outer chamber 192 through a passageway in cylinder head 52. This passageway is formed by a hydraulic bore 194 and the transverse hydraulic bore 196 which is in fluid communication with ram change cylinder 56. Hydraulic bore 196 is also plugged at 198. The hydraulic bore 176 of ram change piston 172 extends through the axial length of ram change piston 172 and is in fluid communication with hydraulic bore 196. Thus, the hydraulic fluid in outer chamber 192 may be relieved upon the opening of the actuator by the passage of hydraulic fluid through ram change piston 172 and into the hydraulic ports of housing 14 to a sump (not shown) connected with the accumulators.

To close actuators 26 and 28, the process is reversed in that hydraulic fluid is introduced into the hydraulic bore 176 in the direction of the arrow and through bores 194, 196 into outer chamber 192. A like passageway is provided between outer chamber 192 and ram change cylinder bore 62 to allow the simultaneous passage of hydraulic fluid into ram change cylinder 54. The hydraulic pressure is applied across annular area 169. This causes operating piston 90 and booster and stroke limiting apparatus 130 to travel through the shearing and sealing strokes as previously described. These strokes contract inner chamber 184 causing the hydraulic fluid to be relieved through bores 190, 186, into hydraulic cylinder 54 and through ports 182, 174 of ram change piston 170 and into housing 14 to the sump. Once in the closed position, lock screw 120 may be threaded into aperture 122 until it engages trailing rod 86 to maintain the closed position even if hydraulic pressure is lost.

As an example, in a seven inch shear-ram type blowout preventer, in excess of 108,000 pounds of force may required to shear pipe string 12. With the accumulators having hydraulic fluid under 3,000 psi pressure, the hydraulic fluid is directed through the bypass around the regulator so as to provide actuator 26 with approximately 2,800 psi pressure. Although this pressure may approach 3,000 psi, approximately 2,800 psi is all that the operator may be assured of having available in the field. The operating cylinder 58 has a diameter of 9¼ inches such that a 2,800 psi fluid pressure is applied on the annular pressure area 169 of operating piston 90 and booster and stroke limiting apparatus 130 providing approximately 180,000 pounds of force to shear pipe string 12. The 180,000 pounds of force is applied to the shearing stroke of actuator 26 to thereby shear the pipe. To avoid placing this force on the ram seals which increases the stress in the rubber of those seals thereby dramatically decreasing the service life of the seals, the booster and stroke limiting apparatus 130 bottoms out in counterbore 74 such that a reduced pressure force is applied during the sealing stroke. Apparatus 130 bottoms out before the ram seals contact but after the shearing of pipe string 12. Upon completing the shearing stroke, the operating piston 90 continues its travel within annular channel 160 approximately three-quarters of an inch. The sealing stroke of three-quarters of an inch thereby sealingly engages and energizes the ram seals. The reduction of the annular pressure area to only the area of operating piston 90 reduces the pressure force to approximately 100,000 pounds force on the ram seals. Thus, the force for sealingly engaging and energizing ram seals is reduced approximately 80,000 pounds thereby decreasing the stress in the rubber and increasing the surface life of the seals.

In assembling actuator 26, the terminal ends of ram change cylinders 54, 56 are inserted into counterbores 66, 68, respectively. Further, the terminal end of operating cylinder 58 is inserted into counterbore 74. Thereafter, ram change pistons 170, 172 are disposed in cylinders 54, 56, respectively. The booster and stroke limiting apparatus 130 is mounted around operating piston 90 and held in place by o-ring 150. That assembly is then slidingly received by piston bore 60 of operating cylinder 58 with shaft 30 passing through central aperture 82. Cylinder head 52 is then placed over the other terminal ends of cylinders 54, 56 and 58 into bores 70, 72 and annular grooves 76, respectively. The trailing rod 86 is passed through central aperture 88. As best shown in FIGS. 2 and 3, tie rods 199 extend from bonnet 50 and through bores in cylinder head 52 to fasten head 52 to bonnet 50. Actuator 26 is fastened to housing 14 by bonnet bolts 197. Lock screw housing 116 and lock screw 120 are then assembled on top of cylinder head 52 by fasteners 118. As shown with respect to ram change operating piston 170, each ram change piston includes a plurality of flats 208 for threading the threaded ends 178, 180 of ram change pistons 170, 172, respectively into the threaded hydraulic ports (not shown) in housing 14 of ram-type blowout preventer 10. In the assembly, the tie bolts 199 draw the respective parts together with the terminal ends of operating cylinder 58 bottoming out first before the terminal ends of ram change cylinders 54, 56 bottom out in bores 66, 68 and 70, 72.

As can be appreciated by one skilled in the art, ram change pistons 170, 172 and ram change cylinders 54, 56 may be used to extend actuator 26 away from housing 14 for the purpose of changing rams 22. This is accomplished by removing bonnet bolts 197 such that upon the introduction of hydraulic fluid into ram change piston 172 through bore 176 to close the rams, the hydraulic fluid acts on cylinder head 52 and moves actuator 26 outwardly on ram change pistons 170, 172 since bonnet bolts 197 no longer connect actuator 26 to housing 14. Further, tie bolts 199 may be removed to remove cylinder head 52 and allow for the changing of booster and stroke limiting apparatus 130, reversing its alignment, as hereinafter described in further detail, for use in a pipe ram operator.

This construction of actuator 26 substantially reduces the weight of the actuator by as much as twenty percent. The prior art actuators include a bonnet which completely encloses the ram change cylinders and also forms a cylindrical skirt around operating piston 90. This cylindrical skirt not only adds weight but restricts the size of the operating cylinder 58 and thus the effective pressure annular area of the operating piston. Thus the construction of the present invention allows for an enhanced pressure area to increase the pressure force to be applied during the operation of the actuator. Previously, such an enhanced pressure force was undesirable because the pressure force was applied not only during the shearing operation but also during the sealing operation. Although the enhanced pressure force was desirable for the shearing operation, it was undesirable during the sealing operation because such an enhanced force was much greater than that required for the sealing operation and tended to substantially shorten the life of the seals on the rams. One of the substantial advantages of the present invention is that the actuator has a shearing stroke with a large pressure force to shear the pipe and a sealing stroke providing a reduced pressure force to seal the rams.

Figure 8A:
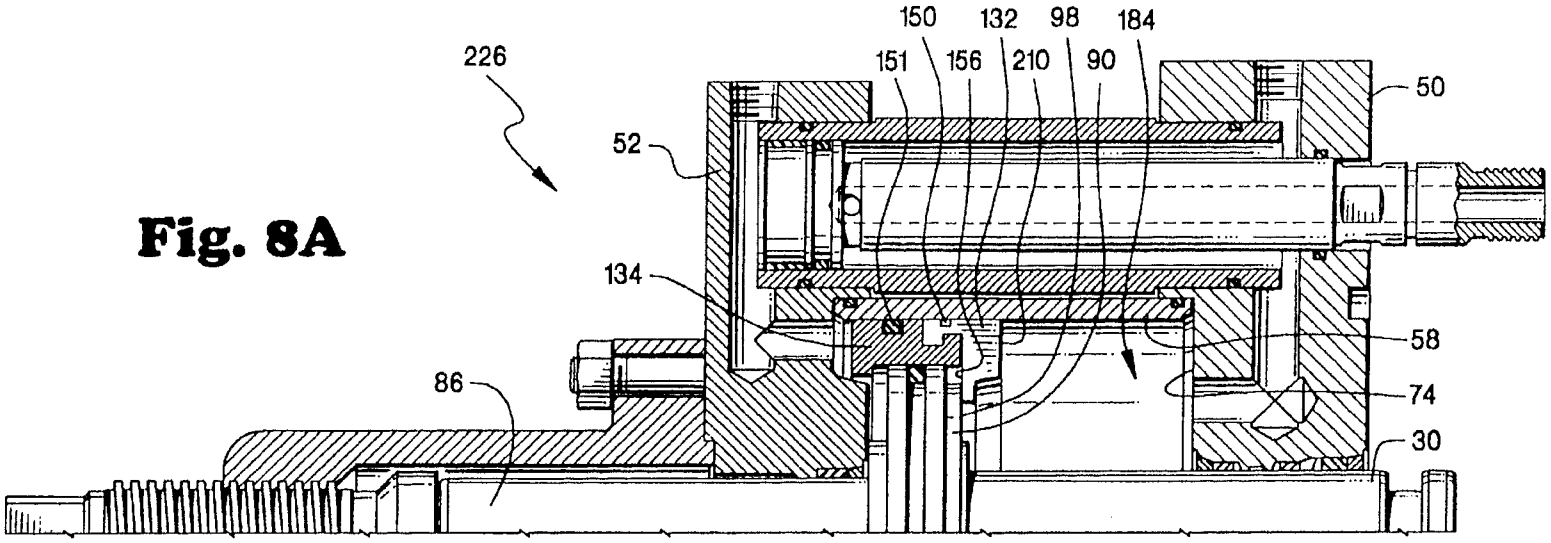
FIGS. 8*a* and 8*b* are cross-sectional side elevation view of the actuator for a pipe ram-type blowout preventer utilizing the booster and stroke limiting apparatus of the present invention with the top half of FIG. 8 showing the open position and the bottom half of FIG. 8 showing the closed position.
Figure 8B:
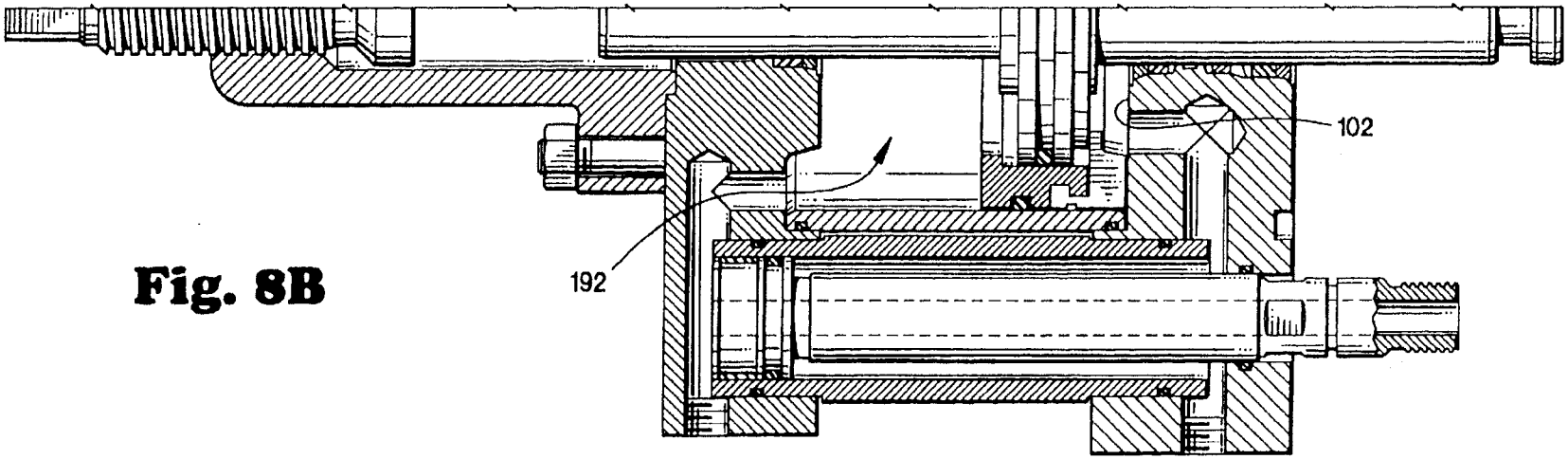

Referring now to FIG. 8, there is shown an actuator 226 adapted for the actuation of pipe rams on a ram-type blowout preventer (not shown) to sealingly engage around a pipe string (not shown) extending through the bore of a blowout preventer. As previously discussed, a pipe ram-type blowout preventer doses opposed rams around the pipe string to sealingly engage the pipe string and close off the bore. One of the principal advantages of the present invention is that actuator 26 for a shear ram-type blowout preventer may be modified for use as actuator 226 for a pipe ram-type blowout preventer by merely reversing the booster and stroke limiting apparatus 130 within the operating cylinder, as hereinafter described in further detail. This is the only difference between actuator 26 and actuator 226 and thus, the numerals utilized in the description of actuator 26 are also be used in the description of actuator 226 where such features are the same.

The top portion of FIG. 8 illustrates actuator 226 in the ram open position and the lower half of FIG. 8 illustrates actuator 226 in the ram closed position. Actuator 226 includes operating cylinder 58 disposed between bonnet 50 and cylinder head 52. Operating piston 90 with shaft 30 and trailing rod 86 are disposed within operating cylinder 58.

Booster and stroke limiting apparatus 130 is shown mounted around the outer circumference of operating piston 90 but inverted within cylinder 58 such that stroke limiting spacer 132 is on the radially inward side of operating piston 90 and booster piston 134 is on the radially outward side of piston 90. These positions are the reverse of actuator 26 of shear ram-type blowout preventer 10.

Figure 9C:
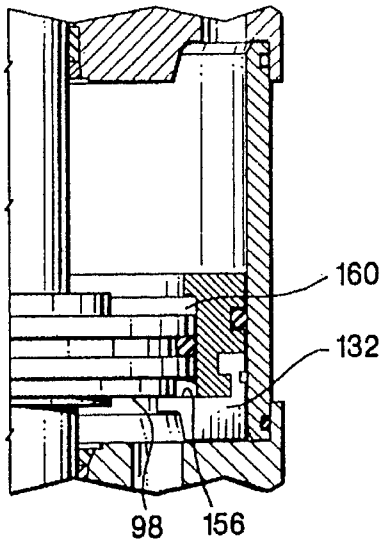
FIGS. 9A, B and C illustrate the operating piston and booster and stroke limiting apparatus at various positions of the operating piston during the stroke of the pipe ram of FIG. 8.
Figure 9B:
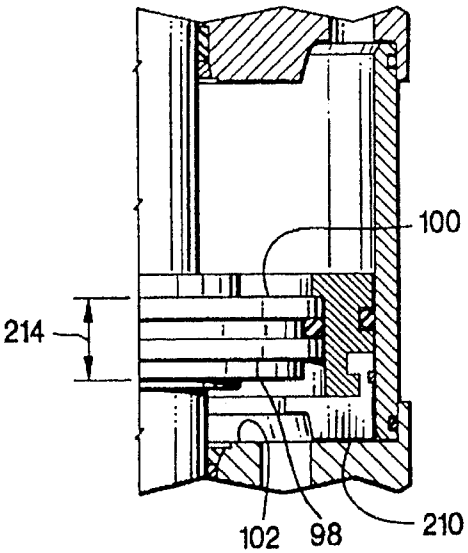
Figure 9A:
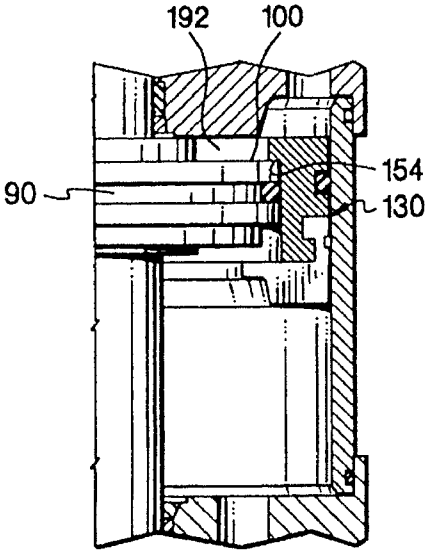

Referring now to FIGS. 9A, B and C, there is shown the strokes of actuator 226 to close the pipe rams of the pipe ram-type blowout preventer. As previously described, to close the rams of the blowout preventer, hydraulic fluid under pressure is introduced into hydraulic bore 176 of ram change piston 172. The hydraulic fluid pressure passes into outer chamber 192 and is applied to the annular pressure area 169 formed by operating piston 90 and booster and stroke limiting apparatus 130. As shown in FIG. 9A, bearing surface 154 of booster piston 134 engages the upper surface 100 of operating piston 90. Operating piston 90 and booster and stroke limiting apparatus 130 travel together from the position shown in FIG. 9A to the position shown in FIG. 9B where the lower annular stop surface 210 of spacer 132 engages the bottom surface 102 of counterbore 74. This travel of the combined operating piston 90 and booster and stroke limiting apparatus 130 may be called the initial or large sealing stroke which applies a full pressure force on annular area 169 to the stroke of the rams for sealingly engaging the seals of the rams against the pipe string passing through the bore of the pipe ram-type blowout preventer.

As shown in FIG. 9C, after the booster and stroke limiting apparatus 130 bottoms on surface 102, operating piston 90 continues its stroke within channel 160. This travel continues until annular surface area 98 engages the stop surface 156 of spacer 132. This stroke may be termed the reduced sealing stroke since only the hydraulic pressure on the upper face of operating piston 90 provides a pressure force for placing the seals of the rams into final sealing engagement around the pipe string. The length of the travel of the reduced sealing stroke may be measured by the radial height 214 extending between surface 100 of annular flange 106 and surface 98 subtracted from the radial height 168 of annular channel 160. The total stroke of actuator 226 is shorter than the total stroke of actuator 26 by the radial height 212 of stroke limiting spacer 132. This is shown in FIG. 9C. Thus, the stroke limiting spacer 132 shortens the stroke of piston 90 so as to comport with the requirements of a pipe ram-type blowout preventer and also provide the appropriate sealing engagement of the pipe rams around the pipe string.

By way of example, in a seven inch pipe ram-type blowout preventer, the pressurized hydraulic fluid from the accumulators is passed through a regulator to provide a hydraulic pressure of approximately 1,500 psi to the blowout preventer. The 1,500 hydraulic pressure is applied across annular pressure area 169 thereby providing an actuator force of approximately 95,000 pounds on the pipe rams. This 95,000 pounds of force is applied during the initial sealing stroke of operating piston 90 and booster and stroke limiting apparatus 130. Once booster and stroke limiting apparatus 130 bottoms within counterbore 74, operating piston 90 continues to travel within annular channel 160 approximately ⅜ of an inch. This is the travel of the reduced sealing stroke. Due to the reduction of the annular pressure area during the reduced sealing stroke, there is a force of approximately 60,000 pounds applied by operating piston 90 on the pipe rams. The reduction of the force during the initial sealing stroke and reduced sealing stroke is not critical to the effective sealing engagement of the pipe ram seals so as to seal around the pipe string and seal off the bore. The stroke limiting spacer 132 reduces the overall sealing stroke by approximately ⅞ths of an inch.

The present invention avoids dedicated blowout preventers for use either with shear rams or pipe rams since the present invention allows the easy interchangeability of the actuator for use with either shear or pipe rams. As can be seen, the adaptation of actuator 26 for shear rams to that of actuator 226 for pipe rams requires no additional parts nor the replacement of any existing parts. All that is required is the reversal of the booster and stroke limiting apparatus 130 to appropriately limit the stroke to meet the requirements of a pipe ram-type blowout preventer. It can also be seen that a minimum disassembly and re-assembly is required to modify the actuator of the present invention for use either with shear rams or pipe rams. This not only saves the expense of additional or new parts but also reduces the time in the field for modification of the actuator.

The configuration of the actuator of the present invention, although having the same basic function, is constructed in a different manner to reduce weight and to allow for an increased annular pressure area 169. In the prior art, the bonnet includes a cylindrical skirt which extends around the operating cylinder between the operating cylinder and the ram change cylinders. The disposal of the skirt between the cylinders limits the diameter of the operating cylinder. The present invention has eliminated the cylindrical skirt of the prior art so as to allow an increased diameter for operating cylinder 58 and thus an increased annular pressure area 169. For example, in the prior art, a seven inch blowout prevent utilized a 7¼ inch diameter operating cylinder and operating piston. In the present invention, in a seven inch blowout preventer, actuators 26, 226 include an operating cylinder having a 9¼ inch diameter to receive a 7¼ inch operating piston 90, the same size as the prior art piston, but also includes the booster and stroke limiting apparatus 130 such that the overall annular pressure area of operating piston 90 and booster and stroke limiting apparatus 130 is 9¼ inches.

While a preferred embodiment of the invention has been shown and described, modifications thereof can be made by one skilled in the art without departing from the spirit of the invention.

I claim:

1. A ram-type blowout preventer comprising:

a housing with a central bore therethrough and a ram guideway traversing said bore;

a ram slidably movable along said guideway;

an actuator including:

a pressure-responsive cylinder connected to said housing, said cylinder having ends;

a piston having a pressure area responsive to fluid pressure and movably disposed within said cylinder between said ends;

a stem associated with said piston for transmitting relative motion in response to pressure;

a member removably mounted on said piston for movement with said piston and disposed within said cylinder, said member having a first position for increasing said pressure area of said piston while allowing said piston to engage each end of said cylinder and a second position for limiting the movement of said piston within said cylinder by preventing said piston from engaging one of said ends.

2. The ram-type blowout preventer of claim 1 wherein said member includes annular rings forming a channel within which is disposed said piston, one annular ring increasing said pressure area and another annular ring limiting the movement of said piston within said cylinder.

3. The ram-type blowout preventer of claim 1 wherein said member includes first and second annular flanges extending radially inward to form an annular space therebetween, said annular space receiving said piston and allowing said piston to move between said annular flanges, said first annular flange engaging said piston in said first position to increase said pressure area and allowing said piston to engage said ends and said second annular flange engaging said piston in said second position to limit the movement of said piston within said cylinder.

4. The ram-type blowout preventer of claim 3 wherein said member is reversely disposed on said piston with said second annular flange engaging said piston in said first position to increase said pressure area and said first annular flange allowing said piston to engage an end of said cylinder.

5. The ram-type blowout preventer of claim 4 wherein said member includes a first ring having interlocking engagement with a second ring.

6. A ram-type blowout preventer for shearing a pipe and sealing the bore of the blowout preventer, comprising:

a housing with a bore and a ram slidably movable in said housing;

a cylinder mounted on said housing;

said cylinder having first and second ends;

said first and second ends having fluid apertures therethrough for the passage of fluid pressure;

a piston having a pressure area responsive to fluid pressure allowing said piston to stroke within said cylinder between engagement with said ends and having stem means for transmitting relative motion to said ram in response to said stroke;

a member disposed on said piston having a first position for increasing said pressure area of said piston for moving said ram to shear the pipe while allowing said piston to engage each of said ends and a second position for reducing said stroke of said piston for moving said ram to seal the bore by preventing said piston from engaging one of said ends.

7. The ram-type blowout preventer of claim 6 wherein said member includes first and second annular flanges extending radially inward to form a channel therebetween, said annular space receiving said piston and allowing said piston to move between said first and second annular flanges, said member and piston having an increased pressure area upon the engagement of said first annular flange and said piston at said first position and said member engaging an end of said cylinder at said second position causing said piston to move within said space thereby reducing the pressure area to the pressure area of said piston.

8. The ram-type blowout preventer of claim 7 wherein said member is reversely disposed on said piston with said second annular flange engaging said piston in said first position to increase said pressure area and allow said piston to engage each of the ends of said cylinder and said first annular flange engaging said piston in said second position to limit the movement of said piston within said cylinder.

9. A ram-type blowout preventer comprising:

a housing having a central bore therethrough and a ram guideway transversely to said bore;

a ram slidably movable along said guideway;

an actuator including:

a pressure-responsive cylinder adapted for connection to the housing;

a piston having a pressure area responsive to fluid pressure and movably disposed within said cylinder;

a stem associated with said piston for transmitting relative motion in response to pressure;

a member removably mounted on said piston for movement with said piston and disposed within said cylinder for increasing said pressure area of said piston and for limiting the movement of said piston within said cylinder;

said member including first and second annular flanges extending radially inward to form an annular space therebetween, said annular space receiving said piston and allowing said piston to move between said annular flanges, said first annular flange engaging said piston in a first position to increase said pressure area and said second annular flange engaging said piston in a second position to limit the movement of said piston within said cylinder;

said member being reversely disposed on said piston with said second annular flange engaging said piston in said first position to increase said pressure area and said first annular flange allowing said piston to engage an end of said cylinder;

said member including a first ring having interlocking engagement with a second ring;

said first ring being split to allow for said interlocking engagement with said second ring.

10. A ram-type blowout preventer for shearing a pipe and for sealing the bore of the blowout preventer, comprising:

a housing with a bore and a ram slidably movable transversely to said bore;

a cylinder mounted on said housing and having first and second ends;

fluid apertures associated with said first and second ends for the application of fluid pressure;

a piston having a pressure area responsive to fluid pressure causing said piston to stroke within said cylinder between said ends;

said piston having a full stroke upon first engaging said first end and then moving under fluid pressure into engagement with said second end;

said piston having a stem for transmitting relative motion to said ram in response to said stroke;

a reversible member disposed on said piston, said reversible number having an additional pressure area responsive to fluid pressure but having a reduced stroke within said cylinder; and said reversible member having a first position allowing a full stroke of said piston and a second position limiting said stroke of said piston.

11. The ram-type blowout preventer of claim 10 wherein said reversible member has first and second inwardly directed annular flanges forming a channel therebetween for receiving said piston, said piston having annular recesses on each side thereof for receiving said annular flanges.

12. The ram-type blowout preventer of claim 11 wherein said piston includes a stop shoulder on each side thereof for engaging said first and second ends of said cylinder.

13. The ram-type blowout preventer of claim 12 wherein one of said annular flanges has a greater thickness than the other flange, said first end of said cylinder having an annular aperture for receiving said thicker annular flange upon one of said stop shoulders engaging said first end.

14. The ram-type blowout preventer of claim 13 wherein said reversible member is reversed to said second position wherein said thicker annular flange engages said second end to limit said stroke of said piston by preventing said stop shoulder from engaging said second end.

* * * * *